United States Patent [19]

Bennett

[11] Patent Number: 4,951,537

[45] Date of Patent: Aug. 28, 1990

[54] APPARATUS FOR PRODUCING A BLANK FROM STOCK MATERIAL

[75] Inventor: Edward D. Bennett, Pompano Beach, Fla.

[73] Assignee: Ace Technology Corporation, Fort Lauderdale, Fla.

[21] Appl. No.: 250,936

[22] Filed: Sep. 29, 1988

[51] Int. Cl.[5] ..... B21D 45/02

[52] U.S. Cl. ..... 83/76.6; 83/128; 83/123; 72/344; 72/427; 72/453.13; 267/119

[58] Field of Search ..... 83/76.1, 76.6, 124, 83/123, 125, 128, 127, 129, 130, 131; 72/344, 427, 453.13; 267/119

[56] References Cited

U.S. PATENT DOCUMENTS

| | | | |
|---|---|---|---|
| 3,564,959 | 2/1971 | Harada | 83/124 |
| 3,570,343 | 3/1971 | Wolnosky | 83/124 |
| 4,774,865 | 10/1988 | Wallis | 83/128 |

*Primary Examiner*—Donald R. Schran
*Attorney, Agent, or Firm*—Davis, Bujold & Streck

[57] ABSTRACT

An improvement to a stamping press having a blanking punch and die combination comprising a blanking die defining an opening, a cooperating blanking punch dimensioned closely to mate with the opening wherein the die edge defining the opening is radiused to cause metal flow, a stock engaging shedder displaceable within the die opening to engage and clamp stock, and a stripper encircling the blanking punch and displaceable therealong to remove surplus stock after a blanking operation. The improvement comprises the stripper being disposed to engage and clamp stock being punched by the blanking punch and die. Additionally, there is a variable pressure source connected to cause the stripper to engage and clamp the stock during punching of the stock under a pressure low enough to permit the stock to flow away from the blanking punch and high enough to prevent the stock from bending and to cause the stripper to exert sufficient force on the stock following punching of the stock to strip the stock from the blanking punch. The preferred variable pressure source comprises a piston connected between the stripper and a fixed point and a variable pressure source operably connected to the piston. The variable pressure can be set for different types and thicknesses of material.

18 Claims, 7 Drawing Sheets

APPARATUS FOR PRODUCING A BLANK FROM STOCK MATERIAL

BACKGROUND OF THE INVENTION

This invention relates to a method and apparatus for producing a smooth edged blank from stock material and, more particularly, to an improvement to the method and apparatus of the inventor herein disclosed in U.S. Pat. No. 4,267,753, issued May 19, 1981.

Prior to my above-referenced patented invention, the production of stampings from stock material was either by a conventional stamping process or by a so-called "fineblanking" process. A stamping produced by conventional methods suffers from the disadvantage known in the art as "die break". When a stamping is produced by conventional methods, the cooperating punch and die produce an initial shearing action, after which the blank is severed by fracturing. A ridge, known as a "shear" extends around the edge of the stamping and divides the portion that sheared from the portion that has fractured. The fractured portion is the die break and is both tapered and rough and granular in nature. As the thickness of the blank from which the stamping is produced increases, so does the problem of die break.

The problem of die break was, for a long time, largely averted only by the known process of fineblanking. Fineblanking is carried out by positive retention of the blank and stock material in such manner as to prevent die break when the punch and die perform their blanking operation. By eliminating the die break portion, the entire edge of the stamping is straight and all shear and there is no fracture or taper. Fineblanking finds particular application where component parts having close tolerances are required since when a blank is produced by fineblanking many subsequent machining operations, such as grinding, milling, etc., are rendered unnecessary. Although the process of fineblanking has these beneficial and advantageous features, it suffers also from substantial drawbacks. Two of the most serious drawbacks being the need to provide a special press and the slow speed of operation of such a press. The special press has typically been a triple action punch press which operates to provide three required forces, i.e. shear pressure, "vee ring" pressure and counter pressure. The required special press is particularly expensive and must be extremely robust to provide sufficient support to absorb reaction, sudden pressures, and all vibration.

Additionally, fineblanking presses must securely clamp both the blank and the stock material from which the blank is stamped. To this end, it has been necessary to provide a special component feature to encircle the area to be blanked out. That special component conventionally comprises an upstanding pointed ridge which serves to engage and bite into the stock material around the area to be blanked out. The ridge is termed a "stinger" and may be embodied in a tooling component known as the blanking die or may, in some embodiments, be embodied in a tooling component known as a "stripper", which is utilized to remove the surplus stock material after the stamping or blank has been removed. In either event, the precise location of the stinger and the need securely to clamp the surplus blank material necessarily results in a press which is intricate, expensive and cumbersome. Quite apart from these inherent disadvantages, it will be appreciated that the utilization of a stinger requires sufficient surplus stock material to permit the desired clamping, thereby leading to waste.

My above-referenced patented invention did away with the need to provide a stinger and provided a method of producing straight side stampings which does not involve clamping of the stock material around the area to be blanked. The invention has achieved great commercial success and acceptance under the tradename GRIP flow. The elimination of the stinger not only allows more stampings to be produced per unit length of stock material but, moreover, allows the stock material freely to flow away from the blanking punch, which has the beneficial effect of reducing heat and friction around the blanking punch during stock removal, thereby increasing the life of the blanking punch, increasing production speed, and eliminating work hardening of the edge of the stamping.

The invention also allows the use of a standard punch press of the type commonly found in practically all metal stamping plants. This standard press, which is simple in construction when used in accordance with the invention, is capable of operation at speeds inappropriate for fineblanking.

According to my above-referenced invention, there is provided a blanking punch and die combination comprising a blanking die defining an opening, a cooperating blanking punch dimensioned closely to mate with the opening, the die edge defining the opening being radiused, a stock engaging shedder displaceable within the die opening to engage and clamp stock and subsequently remove the stamping from the blanking die, a stripper encircling the blanking punch and displaceable therealong to remove surplus stock after a blanking operation, and spacer means disposed between the blanking die and the stripper to space the blanking die and the stripper apart by a distance exceeding the thickness of the stock. Such a combination is intended to be incorporated in a stamping die. Accordingly, the invention also provides a piercing punch and die opening in the blanking punch. The invention also includes a press incorporating the stamping punch and die One feature of the invention is the provision of a radiused or radiused edge of the die which cooperates with the blanking punch. It has already been explained how the elimination of a stinger enables the surplus stock material to flow away. The provision of this radiused or radiused edge enhances such flowing away of scrap material. In fact, this feature should be considered in conjunction with the increased speed of operation made possible by the press of the invention. With regard to the increased speed of operation, the advantage obtained by the invention can best be explained by observing that prior fineblanking presses operate to extrude metal to achieve a smooth edge whereas my prior invention makes it possible to stamp the metal to produce a product having the same quality.

Referring now to FIG. 1, there is illustrated a press incorporating a stamping die for effecting a blanking and piercing operation according to my above-referenced prior invention. The illustrated press serves simultaneously both to smooth edge blank and smooth edge pierce an article from a sheet or strip of stock material in a single stamping operation. To this end, the press incorporates a ram 10 movable towards and away from a press bed 12 by means of, for example, a rotating crankshaft. An upper die shoe 14 is carried by the press ram 10 and a lower die shoe 16 is mounted to the press bed 12. The lower die shoe is securely attached to the press bed 12 by, for example, screws. The upper die shoe 14 is secured to the ram 10 through a spring loaded power pack, generally designated 20, having a housing 28 having a base, depending side walls and a cover which define an internal chamber which accommodates a spring 38. That spring bears on a platform 40 to urge the platform downwardly into abutting engagement with the cover. The cover is secured to the side walls and the upper die shoe 14 is, in turn, secured to the cover. For convenience, this joint securing may be effected by common screws extending from the upper die shoe 14 through the cover and into the side walls.

It will be appreciated that it is important to ensure that the displaceable component parts of the press are at all times correctly aligned with respect to one another. To this end, guiding pillars 46 upstand from the lower die shoe 16 and pass through registering bores in the upper die shoe 14. The cooperating guiding pillars and bores constrain the upper die shoe 14 to move directly toward and away from the lower die shoe 16 under the influence of the press ram 10.

A blanking punch 50 is secured to the lower die shoe 16 and a cooperating blanking die 52 is secured to and carried by the upper die shoe 14. The punch 50 has a concentric bore extending therethrough from top to bottom, which bore constitutes a piercing die. A cooperating piercing punch 66 is carried by the upper die shoe 14. The leading end of the punch 66 passes through a shedder 74 accommodated within a bore extending through the blanking die 52. The shedder 74 serves to exert a clamping force on the stamping to restrain the latter during piercing and blanking operations. The restraining force is asserted by the spring 38 and is transmitted from that spring via the platform 40 and pins 78 extending through aligned appropriately dimensioned bores in the cover and upper die shoe 14. While the piercing punch 66 is surradiused by the shedder 74, the blanking punch 50 is surradiused by a stripper 86. The stripper 86 is in the form of a plate having a central aperture 88 dimensioned to encompass the external periphery of the blanking punch 50. The stripper 86 is displaceable longitudinally of the blanking punch 50 upwardly towards a supported stamping under the influence of springs 90. The biasing spring force in this respect is transmitted by the springs 90 which abut at one end on a fixed platform 94 and at the other end on a movable platform 96. The spring biased movement of the platform 96 is transmitted to the stripper 86 by elongated pins 98 extending through aligned bores extending through the press bed 12 and lower die shoe 16 respectively.

The operation of the press to both pierce and blank will be described in detail hereinafter. Before detailing the sequence of operations, however, attention is drawn to the fact that spacers 106 are carried on the underside of the blanking die 52 to control the closest spacing between the blanking die and the stripper 86. It is important to note that, according to my prior invention, the depth of the spacers 106 is at least twice the thickness of the stock material to be stamped. Platform 94 is retained to the press frame and proper position by screw bolts. The springs 90 engage the underside of the platform 96. Having described the overall structure of my prior invention, the sequence of operation of that press to perform a piercing and blanking operation will now be described along with limitations thereof to which the present invention is directed.

At the beginning of an operational sequence, the above-described components of my prior invention occupy the position shown in FIG. 1. That is to say, the press ram 10 is fully withdrawn to its uppermost position to create a maximum gap between the blanking punch 50 and the blanking die 52. A strip of stock 122 from which a stamping is to be made is fed into the position shown in FIG. 1 where it overlies the uppermost surface of the blanking punch 50. With the strip of stock in this position the controls are operated to cause the press ram 10 to descend to the position shown in FIG. 2. Upon descent of the press ram 10, a first contact between the relatively movable upper and lower parts of the stamping die is made by the spacers 106 on the uppermost surface of the stripper 86. This initial contact is ensured by the fact that, according to the teachings of my prior patent, the depth of the spacers 106 is at least twice the thickness of the stock material 122. Thereafter, continued downward movement of the press ram 10 causes the stripper 86 to move downwardly against the influence of the springs 90. Secondary contact is established between the underside of the shedder 74 and the uppermost surface of the stock 122. This secondary contact is brought about by so dimensioning the component parts of the stamping die that with the springs 38 in a state of compression sufficient to remove the stamping from the blanking die 52, the underside of the shedder 74 stands proud of the underside of the blanking die 52. Continued downward movement of the press ram 10 and components carried thereby causes the shedder 74 to remain stationary, thereby compressing the spring 38. This compressing action is exerted on the spring 38 through the intermediary of the pins 78 and platform 40.

At this point in the sequence of operation, the respective punches and dies commence the blanking and piercing operations depicted in FIG. 3. To this end, the punch 50 cooperates with the edges of the die 52 defining the bore 76. As mentioned earlier, those edges of the die 52 are radiused. The provision of a radiused or rounding on the operational edges of the die 52 is crucial to the provision of a smooth edge stamping. Referring to FIG. 3 of the drawings, it will be observed at this time that the stock is clamped only over the area which will be occupied by the finished end piece. With the stripper 86 depressed and held clear of the stock by the spacers 106, the scrap material around the edges of the blank is unsupported and, under the influence of the radiused edges, is free to flow during advance of the punch 50 into the die bore 76. In other words, the radiused edges of the blanking die 52 draw the stock material around the edge of the blanking punch 50 and the scrap material is free to flow since it is not contained or held under any pressure. In order to achieve this desired effect, it is not only crucial that the edges of the die 52 are radiused; but, it is also very important that there be minimal clearance between the external periphery of the punch 50 and the wall portions of the die bore 76. The clearance is preferably not more than one percent of the thickness of the material to be stamped. It will be appreciated that piercing of the stock 122 by the piercing punch 66 and die bore 64 is also brought about upon downward movement of the press ram 10. Note that the leading end edges of the piercing punch 66 are radiused, as well.

Although the drawings show the respective punch and die parts relatively positioned so that the blanking operation effected by the punch 50 and cooperating die 52 begins before the piercing operation effected by piercing punch 66 and die bore 64, it is obviously possible relatively to position the piercing punch 66 with respect to the die 52 so that the blanking and piercing operation commence simultaneously. Alternatively, the piercing operation might be arranged to begin before the blanking operation. The time increment, if any, between commencement of the blanking and piercing operations is governed by the position of the forward end of the piercing punch 66 with respect to the underside and radiused edges of the die 52.

Upon completion of the piercing and blanking operations, the press ram 10 is retracted upwardly by the crankshaft. This, in turn, effects a withdrawal of the blanking die 52 and spacers 106 allowing the stripper 86 to follow upwards under the influence of the springs 90 which transmit their force through the pins 98. This final stage in the sequence of operations according to intended performance is shown in FIG. 4 of the drawings. The stripper 86 is shown supporting the removed scrap. Further upward motion of the press ram 10 creates a space between the underside of the shedder 74 and the stamping 124 whereupon the stamping may be removed by any convenient means such as a blast of compressed air.

The foregoing sequence of operations works extremely well for its intended purpose if the stock 122 being stamped is of limited thickness. In order to work, however, it is necessary that the stock spacers 106 be at least twice the material thickness of the stock being stamped, otherwise the stamping after being produced will be retained by the shedder 74, then the stripper plate with its force will force the scrap skeleton around the finished stamping. When the technology described and claimed in my previous patent was developed, the range of metal stamping did not exceed 0.125 inches. As the new method and tooling of my invention was exposed to the metal stamping industry of the world, however, the demand for producing heavy material thickness quickly developed. Attempts to employ the process for producing thicker parts lead to certain problems, however. To use the prior invention for making a stamping .500 inch thick, the stock spacers 106 had to be one inch thick. The problem was that the thick scrap skeleton material 126 bent around the blanking punch 50 and when the stripper plate 86 made contact with the loading corner of the scrap skeleton material 126, it would cause a clamping action around the blanking punch 50. This action would adverse wear on the cutting edge of the blanking punch 50. Tool maintenance requirements and attendant costs were, accordingly, increased. Moreover, as depicted in FIG. 5, heavy stock skeleton material 126 might even deform to the point that it would bite into the cutting edge of the blanking punch 50 and chip the cutting edges of the blanking punch 50. Such a result would, of course, shut down the stamping operation until the blanking punch 50 was resharpened or replaced.

Wherefore, it is an object of the present invention to provide improvements to my above-referenced patented invention which will reduce tool maintenance and subsequent cost.

It is another object of the present invention to provide improvements to my above-referenced patented invention which will increase the speed of operation thereof and extend the range of stamping metal thickness therewith to as great as ⅜ inch.

Other objects and benefits of the present invention will become apparent from the description contained hereinafter when taken in conjunction with the drawing figures which accompany it.

SUMMARY

The foregoing objects have been achieved by the stamping press of the present invention for stamping parts with smooth edges from sheet material stock comprising, a blanking die defining an opening; a cooperating blanking punch dimensioned closely to mate with the opening wherein the die edge defining the opening is radiused to cause metal flow; stamping means for forcing the punch and die into mating relationship through sheet material stock; a stock engaging shedder displaceable within the die opening to engage and clamp the sheet material stock; a stripper encircling the blanking punch and displaceable therealong to remove surplus sheet material stock after a stamping operation, the stripper being disposed to engage and clamp the sheet material stock during punching thereof by the blanking punch and die; and, variable pressure means for causing the stripper to engage and clamp the sheet material stock during punching thereof under a pressure low enough to permit the scrap skeleton stock to flow away from the blanking punch and high enough to prevent the sheet material stock from bending and for causing the stripper to exert sufficient force on the sheet material stock following punching thereof to strip the sheet material stock from the blanking punch.

In the preferred embodiment, the variable pressure means comprises a hydraulic piston connected between the stripper and a fixed point and a variable pressure source operably connected to the piston. Additionally, the variable pressure source comprises a source of hydraulic pressure and a pressure setting valve connected between the hydraulic piston and the source of hydraulic pressure. In an alternate embodiment, the variable pressure means comprises a piston connected between the stripper and a fixed point, a source of hydraulic pressure, and a pressure setting valve connected between the piston and the source of hydraulic pressure.

Further in the preferred embodiment, there are logic means for setting the pressure of the variable pressure means and input means operably connected to the logic means for setting the pressures to be applied to the variable pressure means by the logic means.

DESCRIPTION OF THE PREFERRED EMBODIMENT

Figure 1:
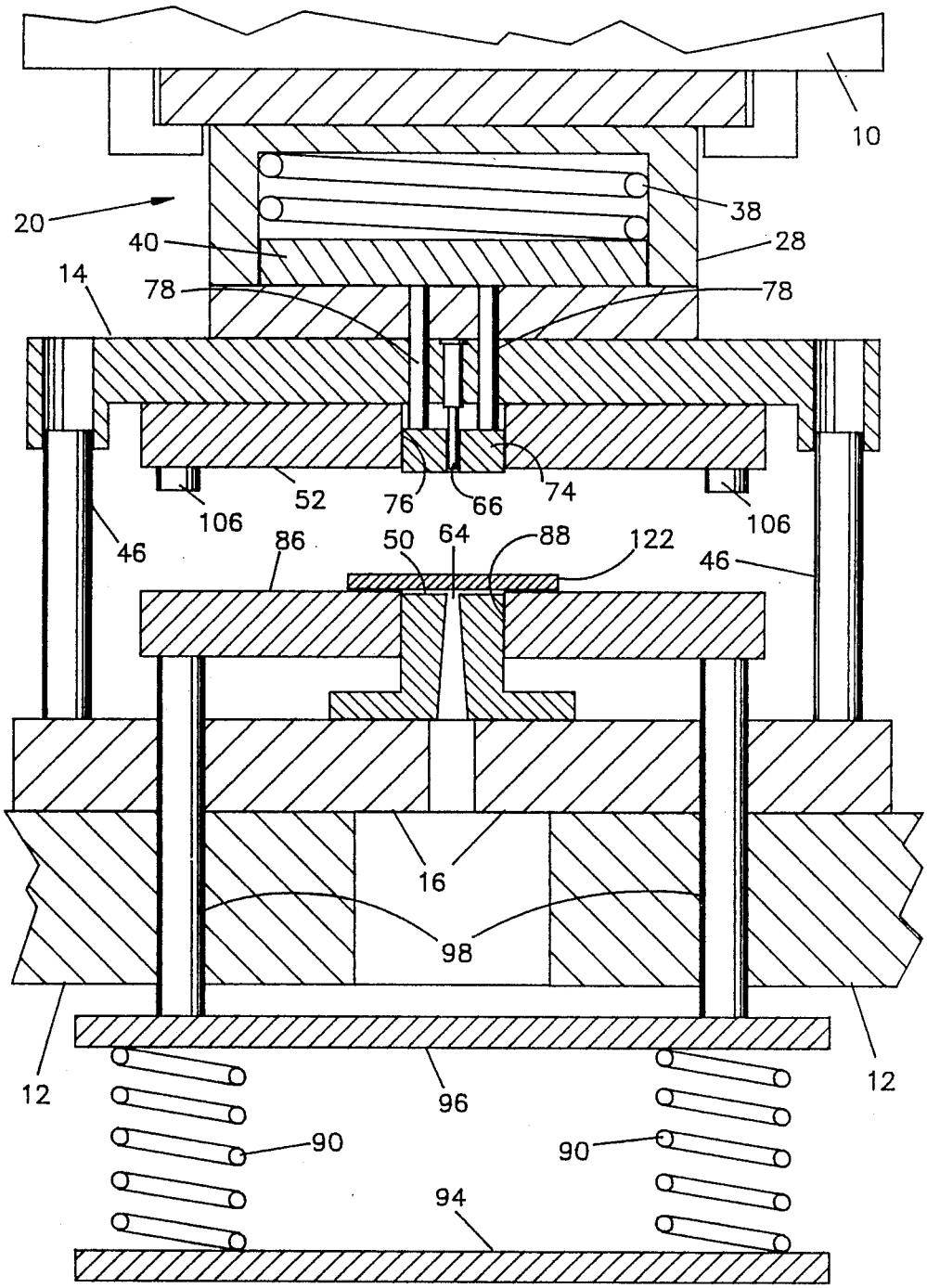
FIG. 1 PRIOR ART
FIG. 1 is a simplified cutaway drawing of my prior art invention of U.S. Pat. No. 4,267,753 and corresponding to FIG. 1 thereof.
Figure 2:
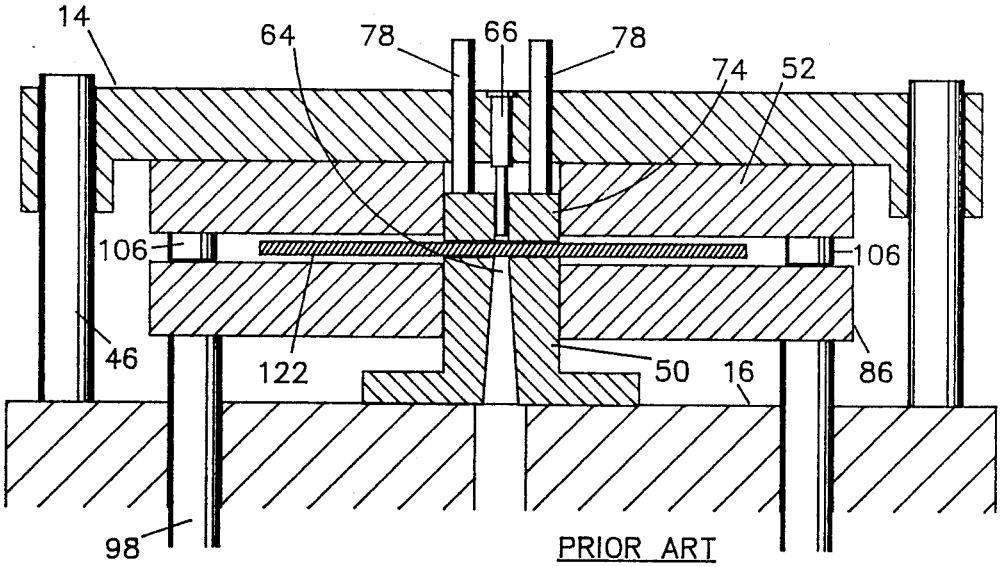
FIG. 2 is a simplified cutaway drawing of my prior art invention showing the clamping of the stock therein prior to punching thereof.
Figure 3:
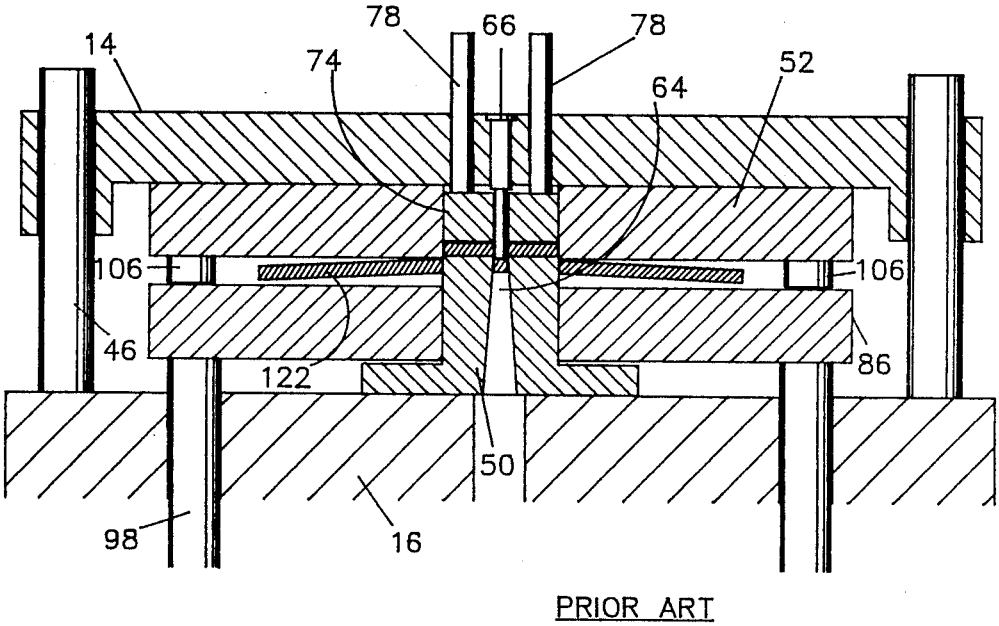
FIG. 3 is a simplified cutaway drawing of my prior art invention showing the stock therein subsequent to the punching thereof.
Figure 4:
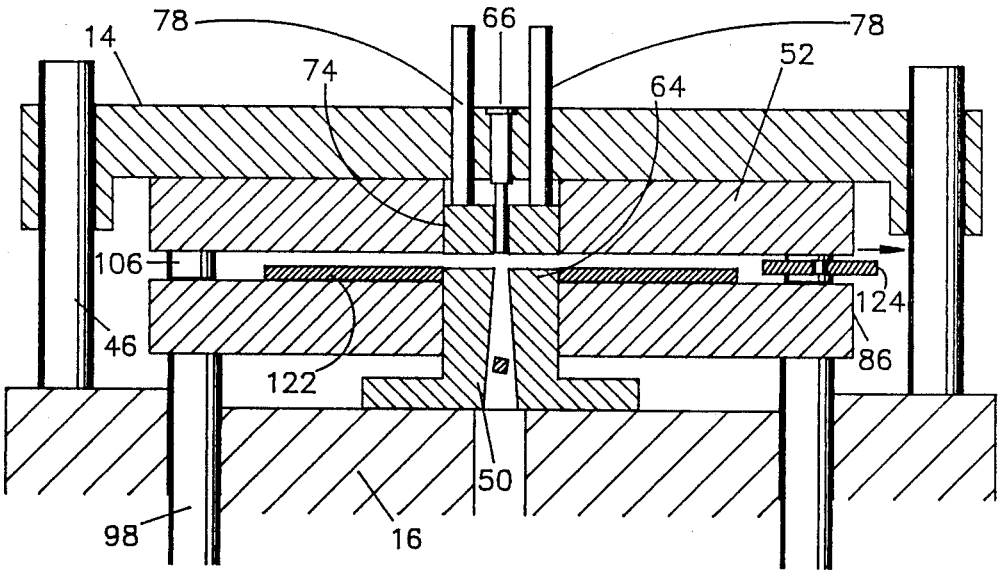
PRIOR ART FIG. 4
FIG. 4 is a simplified cutaway drawing of my prior art invention showing the stock therein subsequent to the punching thereof and following the opening of the press.
Figure 5:
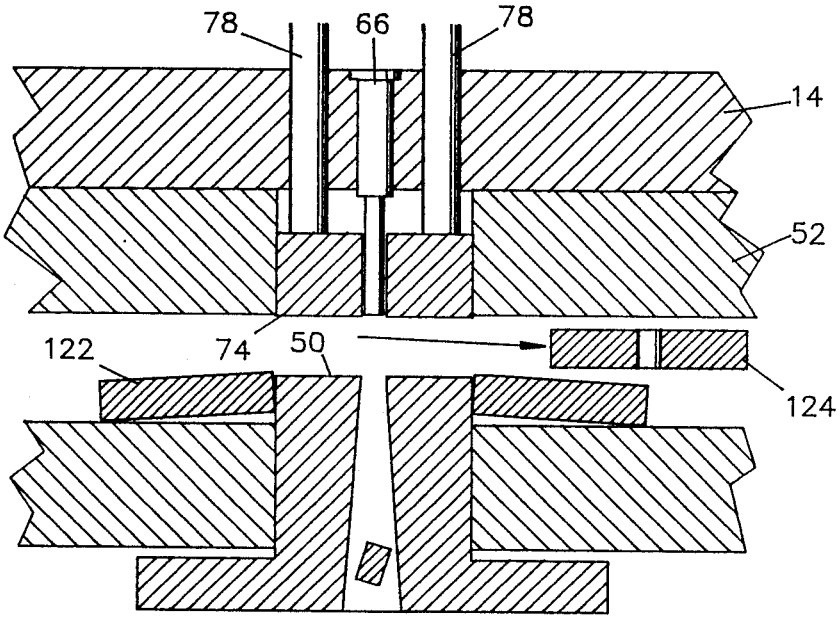
PRIOR ART FIG. 5
FIG. 5 is a simplified cutaway drawing of my prior art invention showing the stock therein subsequent to the punching thereof when heavy stock is punched and it bends showing the problems caused thereby to which the present invention is directed.
Figure 6:
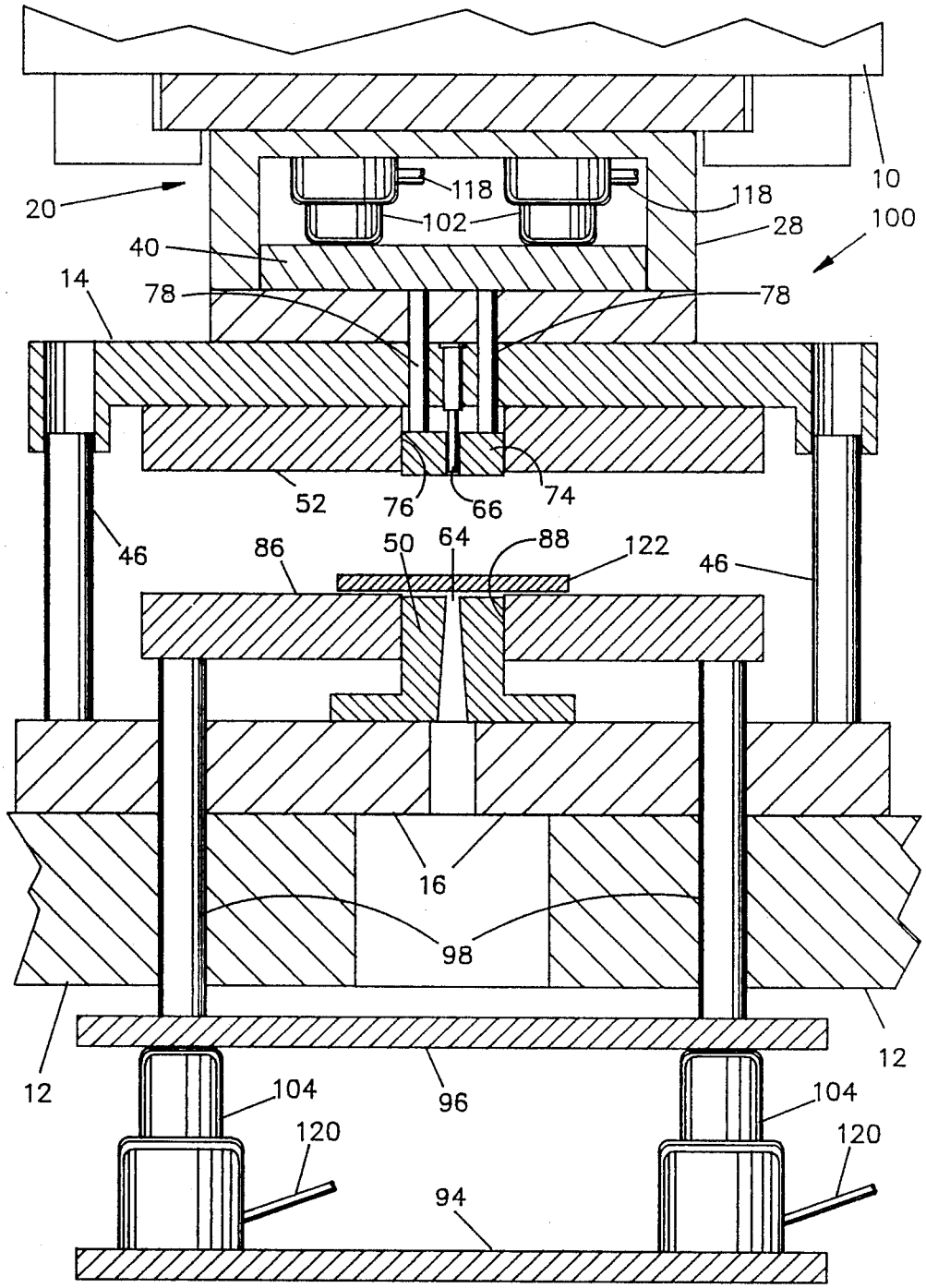
FIG. 6 is a simplified cutaway drawing of my present invention and corresponding to FIG. 1 hereof.

A stamping press according to the preferred embodiment of the present invention is shown in simplified form in FIG. 6 where it is generally indicated as 100. Insofar as the components thereof are similar to the like components of my prior above-referenced and described invention, those components are designated with like numbers to the drawing of FIGS. 1–5. In the interest of simplicity and to avoid redundancy, only those portions that differ from my prior invention will be described in detail herein as the remainder has been previously described in detail previously herein. The press 100 and its unique control system is also shown in functional block diagram in FIG. 7. The preferred steps in the method of operation thereof are shown in FIG. 8.

Figure 7:
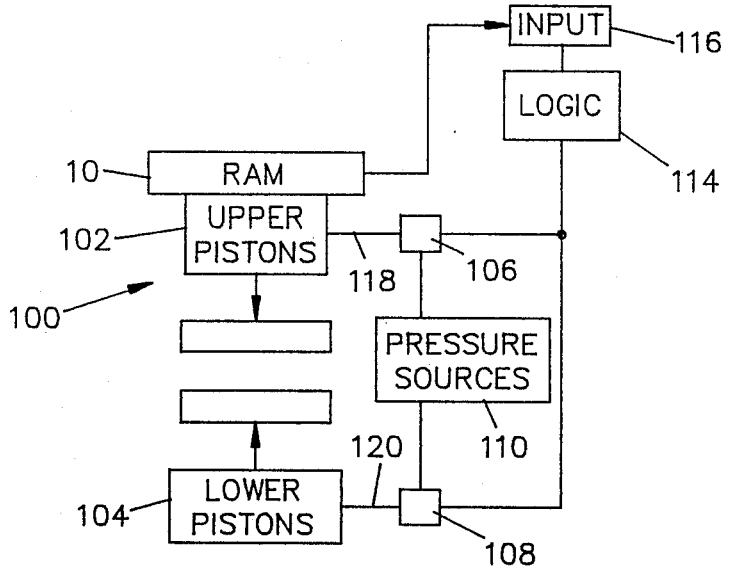
FIG. 7 is a functional block diagram of a punch press according to the present invention in a preferred embodiment thereof.

The objects of the present invention were achieved by removing the spacers 106 from the prior apparatus and by replacing the springs 38 and 90 with a hydraulic pressure system controlled in a manner to achieve the purposes of the removed/replaced components while eliminating the problems associated therewith in the stamping of heavy metal parts. As shown in FIG. 6, the upper spring 38 has been replaced by a pair of upper hydraulic pistons 102. In similar manner, the lower springs 90 have been replaced with a pair of lower hydraulic pistons 104. A single piston or multiple pistons could, of course, be employed in either position, if desired. A pair of pistons in each position is preferred, however. As depicted in FIG. 7, in the preferred embodiment the upper pistons 102 and lower pistons 104 are connected through associated pressure controlling valves 106 and 108 to sources of pressure 110. In the tested embodiment of this invention, the pressure source 110 has a hydraulic pump connected to the pistons 102, 104 through hoses 118 and 120, respectively. A completely pneumatic system employing, for example, pressurized nitrogen gas could, of course, be employed. The valves 106, 108 are all connected to be controlled by logic 114. In turn, logic 114 is controlled by input 116, which is set in motion by the position of the press stroke during its movement sequence, whereby the performance of the pistons 102, 104 can be modified as best suits particular materials and thicknesses thereof. As those skilled in the art will recognize, the logic 114 and input device 116 could be accomplished either electronically or mechanically. With the general availability of microchips at low cost, the logic 114 and associated input device are most easily implemented with such electronic devices.

Figure 8:
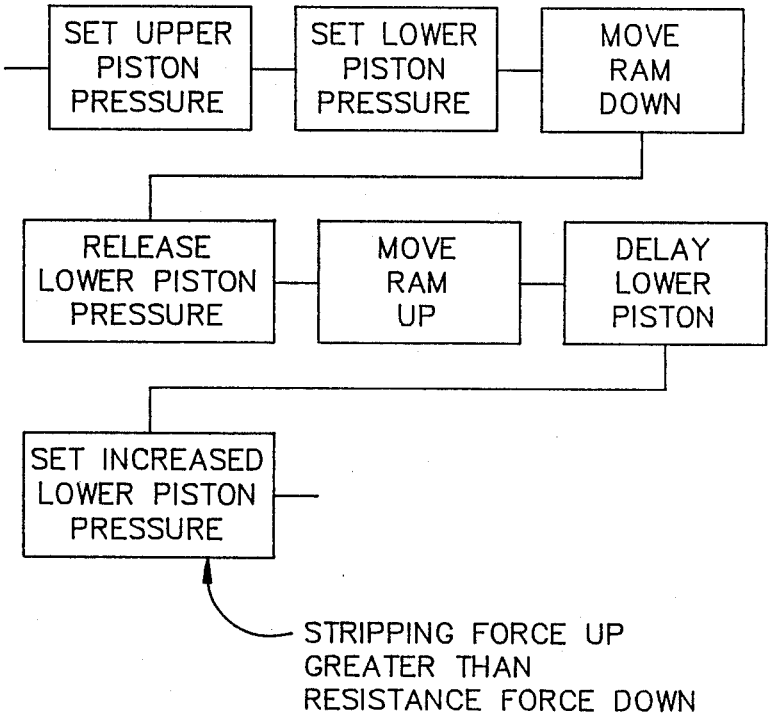
FIG. 8 is a block diagram of the steps of the method of the preferred embodiment of the present invention.
Figure 9:
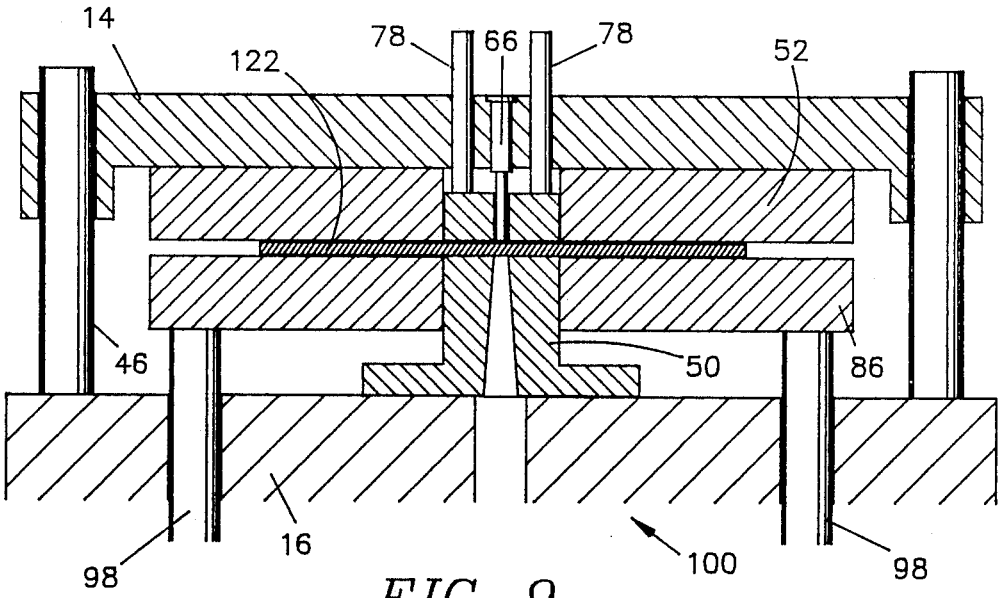
FIG. 9 is a simplified cutaway drawing of the present invention showing the clamping of the stock therein prior to punching thereof.
Figure 10:
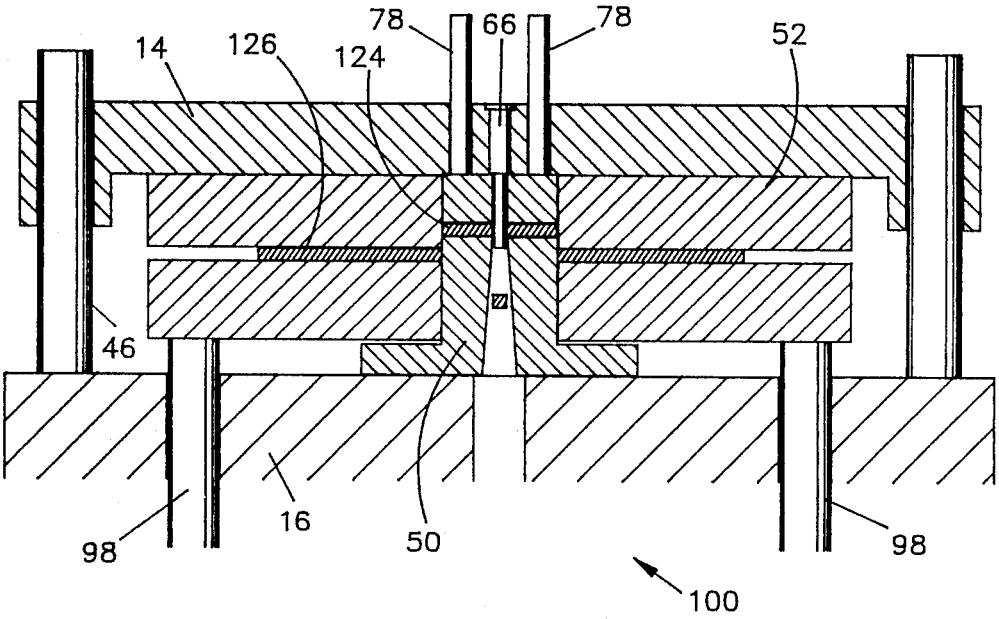
FIG. 10 is a simplified cutaway drawing of the present invention showing the stock therein subsequent to the punching thereof.

The preferred method of operation is shown in block diagram form in FIG. 8 while the steps accomplished by the press 100 are depicted in FIGS. 9–12. The valves 106, 108 are first set to the proper pressure level for the material and thickness to be stamped as input by the device 116. In this regard, if desired, the logic 114 can be pre-programmed with a table of pressures by material and thickness so that the operator need only provide those inputs to have the press automatically set the proper pressures for an optimum stamping operation. With the proper pressures set into the upper and lower pistons 102, 104, the press ram 10 moves downward as depicted in FIGS. 9 and 10. During the downstroke, the die block 52 makes contact with the stock material 122 instead of being spaced therefrom as in my prior invention. Because an adjustable pressure system is employed in place of the fixed pressure spring, the pressure against the stripper plate 86 can be, and is, adjusted to be low enough to allow the scrap skeleton 126 to flow away from the blanking punch 50; yet, be sufficiently strong as to prevent bending of the scrap skeleton 126. The resistant pressure as set by valve 108, therefore, of necessity varies depending on the type of material and thickness thereof in order to fall within these two limiting factors.

Figure 11:
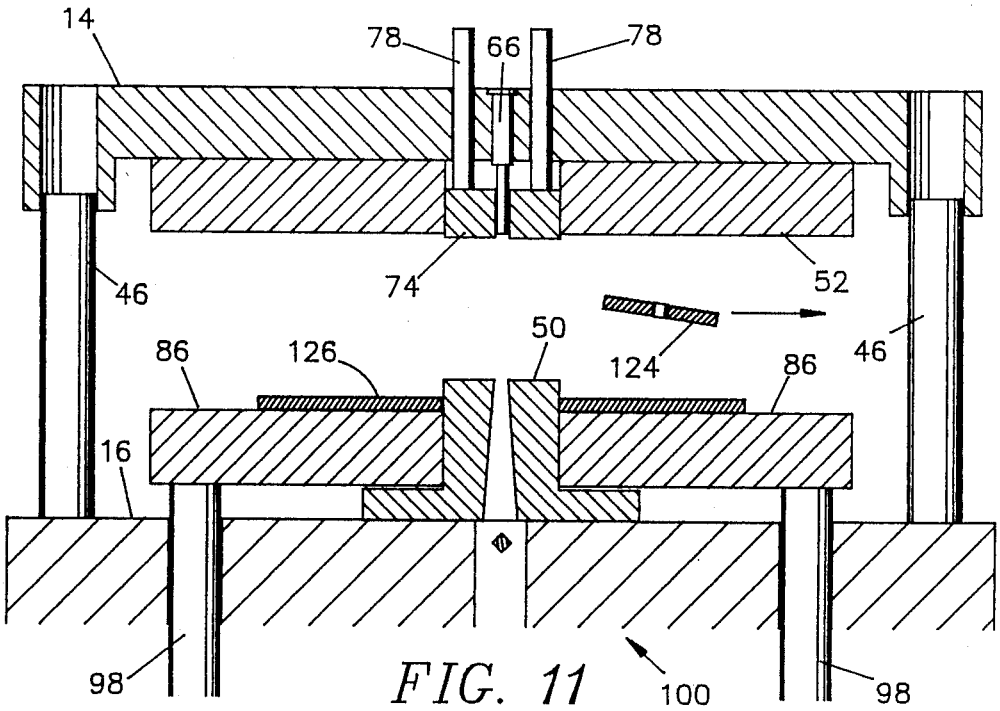
FIG. 11 is a simplified cutaway drawing of the present invention subsequent to the punching operation thereof and following the opening of the press with the punched part released and being ejected and the scrap skeleton retained.
Figure 12:
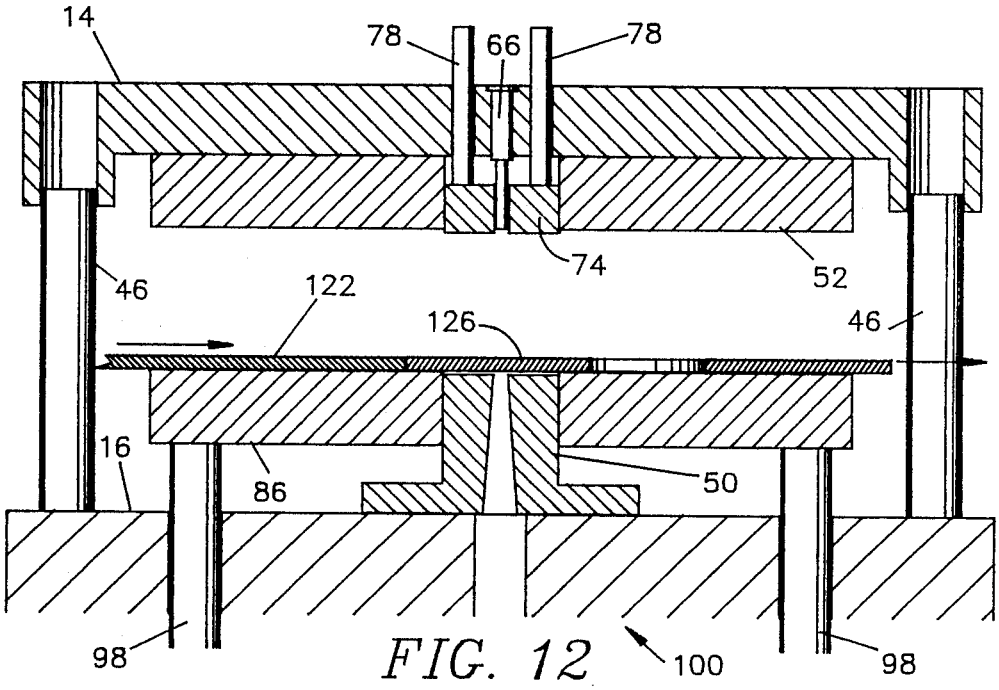
FIG. 12 is a simplified cutaway drawing of the present invention subsequent to the punching operation thereof and following the opening of the press with the punched part ejected and the scrap skeleton stripped.

During the upstroke of the press ram 10, as depicted in FIG. 11 and 12, the stripper plate 86 does not move immediately upward. As depicted in FIG. 8, the pressure is first released from the lower pistons 104. This is achieved by opening the valve and letting the hydraulic oil return to its tank. After producing the stamping 124, the press ram 10 moves upward; however, the stripper plate 86 is delayed in order that the stamping 124 can be ejected from the die 52. When this has been achieved, the stripper plate 86 moves upward to strip the skeleton 126 under an increased pressure as set by valve 104. In the tested embodiment, the time delay is achieved by restricting the return of the hydraulic oil to the lower pistons 104. When the part 124 as formed by the stamping process has been released from the clamping pressure of the shedder 74, the part is removed from the press 100 by either a mechanical knockout arm or a blast of pressurized air as indicated by the arrow in FIG. 11. The stripper plate 86 is then moved upward and strips the skeleton 126 from around the compound blanking punch 50. The stock material 122 is then moved into position for the next stamping and pushes the scrap skeleton 126 ahead of it. Since the scrap skeleton 126 has not been deformed, the punch life is greatly improved and thicker stampings can be made without problem.

It is important to note that the pressure on the stripper plate 86 is greater during the upstroke than during the downstroke. This is necessary because if the force required to strip a thick metal skeleton 126 from the blanking punch 50 was used on the downstroke, it would prevent the scrap material from flowing away from the punch 50 during the punching operation and a smooth edged stamping could not be possible. The importance of this fact was never realized before. It also points out the fact that all stampings made on conventional compound stamping dies without the benefits of my prior invention or this invention have imperfect tapered sides.

Wherefore, having thus described the present invention, what is claimed is:

1. In a blanking punch and die combination comprising a blanking die defining an opening, a cooperating blanking punch dimensioned closely to mate with the opening wherein the die edge defining the opening is radiused to cause metal flow, a stock engaging shedder displaceable within the die opening to engage and clamp stock, and a stripper encircling the blanking punch and displaceable therealong to remove surplus stock after a blanking operation, the improvement comprising:

(a) the stripper being disposed to engage and clamp stock being punched by the blanking punch and die; and additionally comprising, (b) variable pressure means for causing the stripper to engage and clamp said stock during punching of said stock under a pressure low enough to permit said stock to flow away from the blanking punch and high enough to prevent said stock from bending and for causing the stripper to exert sufficient force on said stock following punching of said stock to strip said stock from the blanking punch.

2. The improvement to a blanking punch and die combination of claim 1 wherein said variable pressure means comprises:

(a) a hydraulic piston connected between the stripper and a fixed point; and, (b) a variable pressure source operably connected to said piston.

3. The improvement to a blanking punch and die combination of claim 2 wherein said variable pressure source comprises:

(a) a source of pneumatic pressure; and, (b) a pressure setting valve connected between said hydraulic piston and said source of pneumatic pressure.

4. The improvement to a blanking punch and die combination of claim 1 wherein said variable pressure means comprises:

(a) a piston connected between the stripper and a fixed point;

(b) a source of pneumatic pressure; and, (c) a pressure setting valve connected between said piston and said source of pneumatic pressure.

5. The improvement to a blanking punch and die combination of claim 1 and additionally comprising:

logic means for setting the pressure of said variable pressure means.

6. The improvement to a blanking punch and die combination of claim 5 and additionally comprising:

input means operably connected to said logic means for setting the pressures to be applied to said variable pressure means by said logic means.

7. In stamping press having a blanking punch and die combination comprising a blanking die defining an opening, a cooperating blanking punch dimensioned closely to mate with the opening wherein the die edge defining the opening is radiused to cause metal flow, a stock engaging shedder displaceable within the die opening to engage and clamp stock, and a stripper encircling the blanking punch and displaceable therealong to remove surplus stock after a blanking operation, the improvement comprising:

(a) the stripper being disposed to engage and clamp stock being punched by the blanking punch and die; and additionally comprising, (b) variable pressure means for causing the stripper to engage and clamp said stock during punching of said stock under a pressure low enough to permit said stock to flow away from the blanking punch and high enough to prevent said stock from bending and for causing the stripper to exert sufficient force on said stock following punching of said stock to strip said stock from the blanking punch.

8. The improvement to a stamping press of claim 7 wherein said variable pressure means comprises:

(a) a hydraulic piston connected between the stripper and a fixed point; and, (b) a variable pressure source operably connected to said piston.

9. The improvement to a stamping press of claim 8 wherein said variable pressure source comprises:

(a) a source of pneumatic pressure; and, (b) a pressure setting valve connected between said hydraulic piston and said source of pneumatic pressure.

10. The improvement to a stamping press of claim 7 wherein said variable pressure means comprises:

(a) a piston connected between the stripper and a fixed point;

(b) a source of pneumatic pressure; and, (c) a pressure setting valve connected between said piston and said source of pneumatic pressure.

11. The improvement to a stamping press of claim 7 and additionally comprising:

logic means for setting the pressure of said variable pressure means.

12. The improvement to a stamping press of claim 11 and additionally comprising:

input means operably connected to said logic means for setting the pressures to be applied to said variable pressure means by said logic means.

13. A stamping press for stamping parts with smooth edges from sheet material stock comprising:

(a) a blanking die defining an opening;

(b) a cooperating blanking punch dimensioned closely to mate with said opening wherein the die edge defining said opening is radiused to cause metal flow;

(c) stamping means for forcing said punch and die into mating relationship through sheet material stock;

(d) a stock engaging shedder displaceable within said die opening to engage and clamp the sheet material stock;

(e) a stripper encircling said blanking punch and displaceable therealong to remove surplus sheet material stock after a stamping operation, said stripper being disposed to engage and clamp the sheet material stock during punching thereof by said blanking punch and die; and, (f) variable pressure means for causing said stripper to engage and clamp the sheet material stock during punching thereof under a pressure low enough to permit the sheet material stock to flow away from said blanking punch and high enough to prevent the sheet material stock from bending and for causing said stripper to exert sufficient force on the sheet material stock following punching thereof to strip the sheet material stock from said blanking punch.

14. The stamping press of claim 13 wherein said variable pressure means comprises:

(a) a hydraulic piston connected between said stripper and a fixed point; and, (b) a variable pressure source operably connected to said piston.

15. The stamping press of claim 14 wherein said variable pressure source comprises:

(a) a source of pneumatic pressure; and, (b) a pressure setting valve connected between said hydraulic piston and said source of pneumatic pressure.

16. The stamping press of claim 13 wherein said variable pressure means comprises:

(a) a piston connected between said stripper and a fixed point;

(b) a source of pneumatic pressure; and, (c) a pressure setting valve connected between said piston and said source of pneumatic pressure.

17. The stamping press of claim 13 and additionally comprising:

logic means for setting the pressure of said variable pressure means.

18. The stamping press of claim 17 and additionally comprising:

input means operably connected to said logic means for setting the pressures to be applied to said variable pressure means by said logic means.

* * * * *